US007971544B2

(12) United States Patent
Hillenbrand et al.

(10) Patent No.: US 7,971,544 B2
(45) Date of Patent: Jul. 5, 2011

(54) CLAMPING DEVICE FOR NEEDLES

(75) Inventors: Bernd Hillenbrand, Albstadt (DE); Kai Uwe Haug, Nusplingen (DE); Timo Kaas, Balingen (DE); Fred Schneider, Tübingen (DE); Roland Wäschle, Bisingen (DE)

(73) Assignee: Groz-Beckert, Albstadt (DE)

( * ) Notice: Subject to any disclaimer, the term of this patent is extended or adjusted under 35 U.S.C. 154(b) by 341 days.

(21) Appl. No.: 12/219,332

(22) Filed: Jul. 21, 2008

(65) Prior Publication Data

US 2009/0020055 A1 Jan. 22, 2009

(30) Foreign Application Priority Data

Jul. 19, 2007 (EP) ..... 07014179

(51) Int. Cl.
*D05B 55/02* (2006.01)
*D05B 55/00* (2006.01)

(52) U.S. Cl. ..... 112/226

(58) Field of Classification Search ..... 163/1; 112/222–227

See application file for complete search history.

(56) References Cited

U.S. PATENT DOCUMENTS

| | | | | | |
|---|---|---|---|---|---|
| 266,050 | A | * | 10/1882 | Rainforth | 112/226 |
| 396,350 | A | * | 1/1889 | Bostian | 112/226 |
| 452,395 | A | * | 5/1891 | Staples | 112/226 |
| 1,899,303 | A | * | 2/1933 | Basso | 112/221 |
| 3,125,045 | A | | 3/1964 | Moise | |
| 3,583,345 | A | | 6/1971 | Wilson | |
| 3,658,022 | A | * | 4/1972 | Roger | 112/226 |
| 4,421,041 | A | | 12/1983 | Weisz | |
| 2007/0221110 | A1 | * | 9/2007 | Hillenbrand et al. | 112/226 |

FOREIGN PATENT DOCUMENTS

| | | |
|---|---|---|
| CH | 98 950 | 4/1923 |
| CH | 681 215 | 2/1993 |
| DE | 1 927 498 | 12/1970 |
| DE | 32 25 434 | 4/1983 |
| FR | 1 327 497 | 5/1963 |
| GB | 387073 | 2/1933 |
| WO | WO2006/102774 | 10/2006 |

* cited by examiner

*Primary Examiner* — Ismael Izaguirre

(74) *Attorney, Agent, or Firm* — Fitch, Even, Tabin & Flannery; Norman N. Kunitz

(57) ABSTRACT

A quick-release clamping holder for a sewing needle, embroidery needle or the like has a needle receptacle (2) on which a needle clamping part (8) is preferably pivotally supported. A fixing element (14) is provided in order to clamp and fix the needle clamping part (8) in place, whereby said fixing element is pivotally or rotatably supported relative to a longitudinal central axis (13) of the needle and thus can be slid onto and off the needle clamping part (8). Actuation is simple and safe.

8 Claims, 6 Drawing Sheets

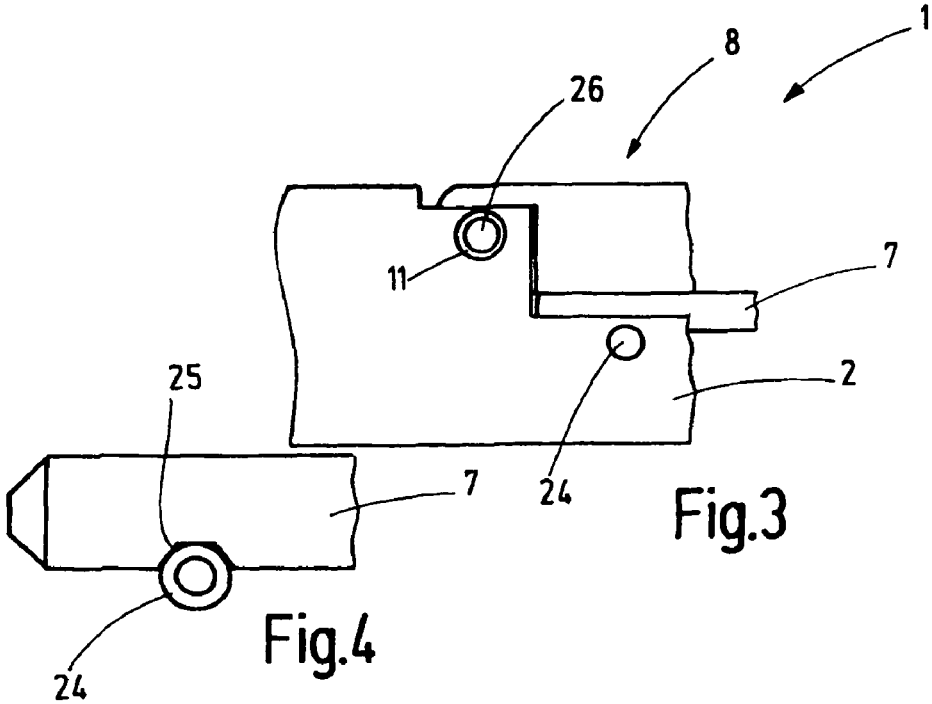
Fig.3
Fig.4
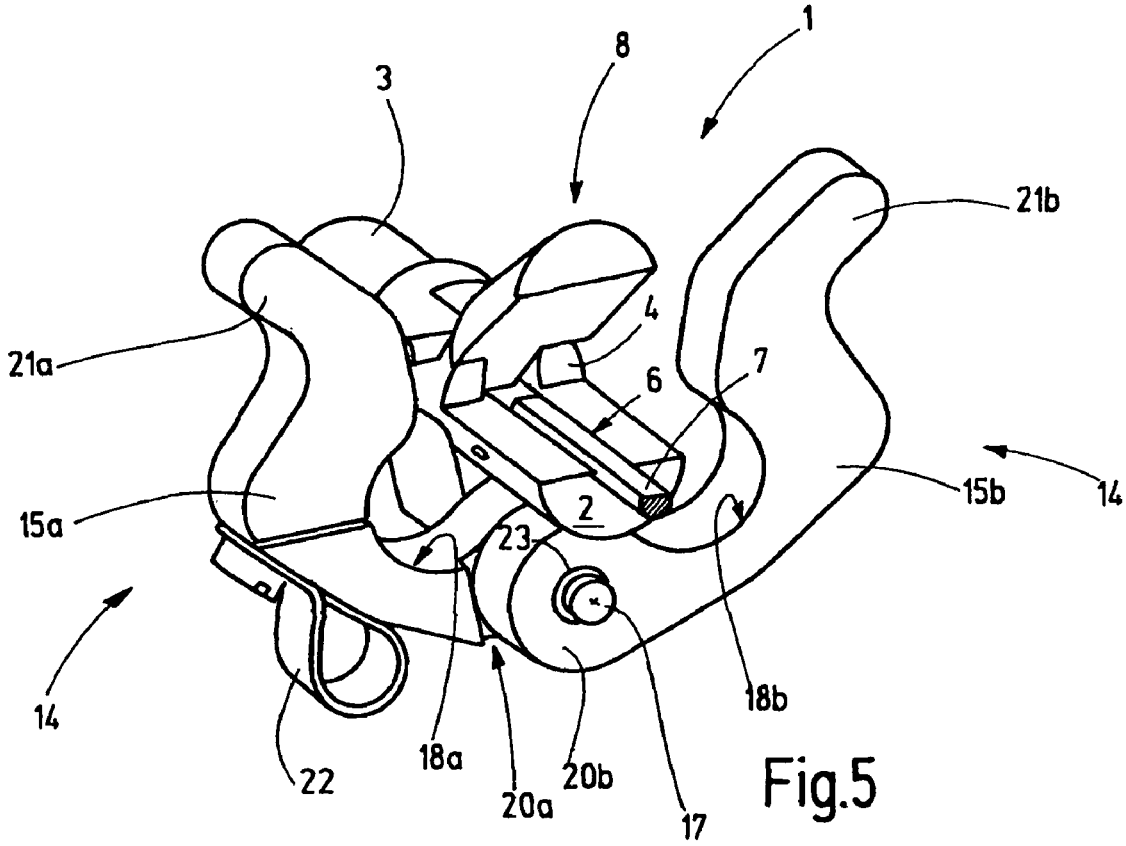
Fig.5

CLAMPING DEVICE FOR NEEDLES

CROSS REFERENCE TO RELATED APPLICATION

The present application claims the priority of European Patent Application No. 07 014 179.1, filed Jul. 19, 2007, the subject matter of which, in its entirety, is incorporated herein by reference.

BACKGROUND OF THE INVENTION

The invention relates to a needle holder that is suitable, in general, for needles and, in particular for embroidery needles, for example, Schifflin needles.

Embroidery machines, in particular large embroidery machines, are provided with needle rods, each having on its end a clamping device for a needle. The needles are also referred to as embroidery needles or as Schifflin needles. During the embroidery process, the needle rods are moved back and forth in axial direction in order to repeatedly puncture the needle through a textile product.

The frequent change of needles is necessary.

To do so, document GB 387 073 suggests that needles held on a bar be mounted in a revolver head which, for example, can be moved into four index positions. If one of the four needles held on the revolver head breaks, the revolver head may be rotated forward by 90° in order to bring a new needle into position. The needles are held on the revolver head by means of a clamping claw, which can be tightened or loosened by means of a fastening screw.

Furthermore, document DE-OS 1 927 498 discloses a needle holder in which several needles are held in a pivotable manner. They can be selectively moved into a rest position or a working position. Consequently, threads of different colors can be selected.

It is the object of the invention to provide a possibility for fastening the needles to the needle rods so as to make possible a simple and rapid needle change.

SUMMARY OF THE INVENTION

The above object generally is achieved according to the present invention with a needle holder that comprises a needle-receiving part with a clamping part and a fixing part, by means of which the needle clamping part can be fixed in a clamping position. The needle holder is provided on a needle rod in an extension. It may also be seamlessly connected in one piece thereto. The fixing element is pushed onto the needle clamping part in order to fix it in place and is moved away from the clamping part in order to release it. Thus, the needle can be fastened in a particularly easy manner to the needle rod, and removed therefrom in an equally easy manner, in one simple manual step. The direction of insertion or removal of the needle is possible transverse to the longitudinal direction of the needle or the needle rod. Thus, the change of the needle is not affected by objects that are in front of the needle tip. Therefore, the manual effort required for changing the needle is quite minimal. On the other hand, the needle is securely held on the needle rod.

The needle-receiving part of the needle holder or the needle rod has, as the seat for the accommodation of the needle, preferably an elongated channel-like recess which is adapted to one end of the needle. This end of the needle, also referred to as the "plunger", represents the holding section. A transverse pin or a transverse rib may be located in the channel-like recess. This pin or this rib may be associated with a notch provided in one end of the needle. However, it is also possible to set state-of-the-art needles with a flattened plunger or end—as they are currently used in large numbers in the textile industry—into such a needle holder. Thus, it is retro-compatible.

Preferably, the needle clamping part is configured as a tension flap that is supported in a manner so as to be pivotable toward the end of the needle and away therefrom. On one side, the end of the plunger or the needle is accommodated by the needle-receiving part. Its other side is held by the needle clamping part, for example having the form of a clamping flap. In tensioned state, the clamping flap or the needle clamping part is radially pushed against the plunger of the needle, as a result of which the needle, in turn, is pushed into the needle-receiving part and thus clamped in place. This clamping position is secured by the fixing element. If, as opposed to this, the fixing element is released, the clamping flap may be folded away from the plunger of the needle. Thus it clears half of the cylindrical space enclosing the plunger. In other words, when the end of the needle is clamped in place, the needle clamping part is moved into a space, which is located—relative to the end of the needle—radially above the seat of said needle. During the release step, the needle clamping part is cleared, i.e., the clamping flap, is moved out of the region of this space. Thus, the embroidery needle can be easily removed from the needle holder. A new needle can simply be set into the needle holder. It is not necessary to axially thread or fit said needle into any openings.

Preferably the needle clamping part and the needle-receiving part, together, essentially complement each other to form a cylindrical external contour when the needle clamping element, e.g., the clamping flap, is in clamping position. This permits a slim design, as well as also a simple fixation of the needle clamping part in the clamping position. This applies, independent of whether the clamping flap can be pivoted about a pivot axis that is transverse to the longitudinal direction of the needle and approximately parallel to a separating surface between the needle-receiving part and the needle clamping part, or can be pivoted about a pivot axis that is oriented in a direction parallel to the needle axis. In both cases, the fixing element may easily be slid over the resultant cylindrical external contour in order to secure the needle clamping part in clamping position.

This shifting of the fixing element preferably occurs in the course of a pivoting motion. For example, the fixing element is configured as a notch lever that is laterally slid over the needle clamping part. In so doing, the fixing element, in one embodiment, may be pivotally supported on the needle-receiving part. The pivot axis is oriented parallel to the needle, for example. It is also possible to support the fixing element so as to be rotatable about the needle-receiving part about a central axis that is concentric to the axis of rotation. Alternatively, the fixing element may also be supported in a pivotable manner on the needle clamping part in order to come into engagement with the needle-receiving part when in clamping position.

The fixing element may be held in its fixing position by at least one detent means. For example, the fixing means may consist of a slightly elastic plastic material that imparts the fixing element with resilience or a spring effect. When configured as a pivotally supported lever with a recess, this lever can be pivoted toward the needle clamping part in such a manner that said lever's recess comes into engagement with the needle clamping part and, at the same time, tensions said needle clamping part relative to the plunger of the needle.

When the aforementioned principles are applied, numerous modifications are possible. In addition, it is possible to used said features in almost any combination with each other. In so doing, the features may be used individually, as well as in any combination or partial combination.

The description hereinafter is restricted to several embodiments of the invention in order to explain essential elements of said invention, as well as other situations. The drawings disclose additional details and are to be referred to as being supplementary.

BRIEF DESCRIPTION OF THE DRAWINGS

FIG. 3 is a side view of a detail of the needle-receiving part and the needle clamping part of the needle holder in accordance with FIGS. 1 and 2.

FIG. 4 is a side view of a plunger of a needle, together with a transverse pin that belongs to the needle-receiving part in accordance with FIG. 3.

FIG. 5 is a perspective view of a second modification of a needle holder with two fixing elements, in an opened state.

DETAILED DESCRIPTION OF THE INVENTION

Figure 1:
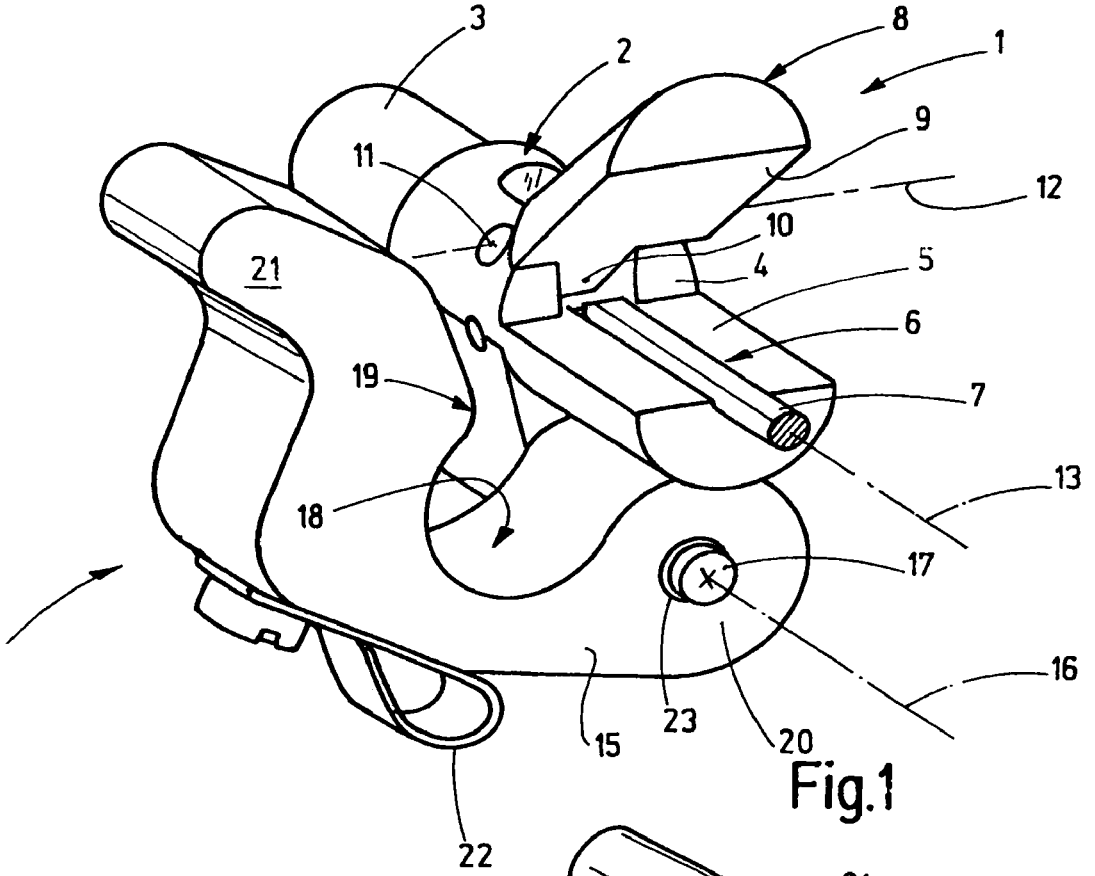
FIG. 1 is a perspective illustration of a first modification of a needle holder with quick-release needle clamping, in opened state.

FIG. 1 shows a needle holder 1 in accordance with the invention, said needle holder being configured as a quick-release clamping holder. This needle holder comprises a needle-receiving part 2 that is disposed to fasten a needle rod. To achieve this, the needle-receiving part 2 is provided with a journal 3 on its one end. Extending away therefrom is the remaining body 4 of the needle-receiving part 2. The body 4 has, on its end opposite the journal 3, approximately the shape of a longitudinally divided semi-cylinder which has a preferably flat surface 5 extending essentially in longitudinal direction. This surface is traversed by a channel-like recess that forms a seat 6 for the accommodation of the end 7 of a needle. This end 7 ("plunger") is disposed to support or fasten the needle. The needle is an embroidery needle, for example.

The seat 6 is associated with a needle clamping part 8 that is configured as a pivotable clamping jaw. This needle clamping part has a semi-cylindrical form and has an also preferably flat surface 9 that faces the preferably flat surface 5. If necessary, the surface 9 may be provided with a groove or other recesses. In the present exemplary embodiment, the end 7 of the needle is flattened, whereby the flattened side faces the surface 9. Apart from that, the needle clamping part 8 is essentially semi-cylindrical, whereby it has, on one end, an extension 10 that is disposed to provide a pivotable support for the clamping part 8 on the body 4. The extension 10 extends into a corresponding recess of the body 4 and is held there by a not specifically illustrated transverse pin. This pin is seated in an appropriate transverse bore 11 and defines a pivot axis 12 for the clamping part 8. As a result of this, the clamping part 8 can be pivoted toward the end 7 of the needle and away therefrom. The pivot axis 12 is preferably oriented in a direction transverse to a longitudinal center axis 13 of the needle. In addition, the pivot axis 12 is preferably oriented parallel to the surface 5. FIG. 1 shows the needle clamping part 8 in its release position. In this release position, an acute aperture angle of at least 45 degrees, preferably at least 75 degrees, is formed between the surface 9 of the needle clamping part 8 and the surface 5 of the body 4. Due to this, it is easy to remove the needle by its end 7 from its seat 6. This is done with the clamping part 8 folded open and with the seat completely exposed.

In addition, a fixing element 14 belongs to the needle holder 1, said fixing element being represented by a notch lever 15 in the present exemplary embodiment. This notch lever is preferably mounted on the needle-receiving part 2 so as to be pivotable about a pivot axis 16, said axis being defined by a journal 17 extending through an opening of the notch lever 15. The journal 17 and the pivot axis 16 preferably extend parallel to the longitudinal central axis 13 that is defined by the seat 6 and thus in a direction transverse to the pivot axis 12.

Figure 2:
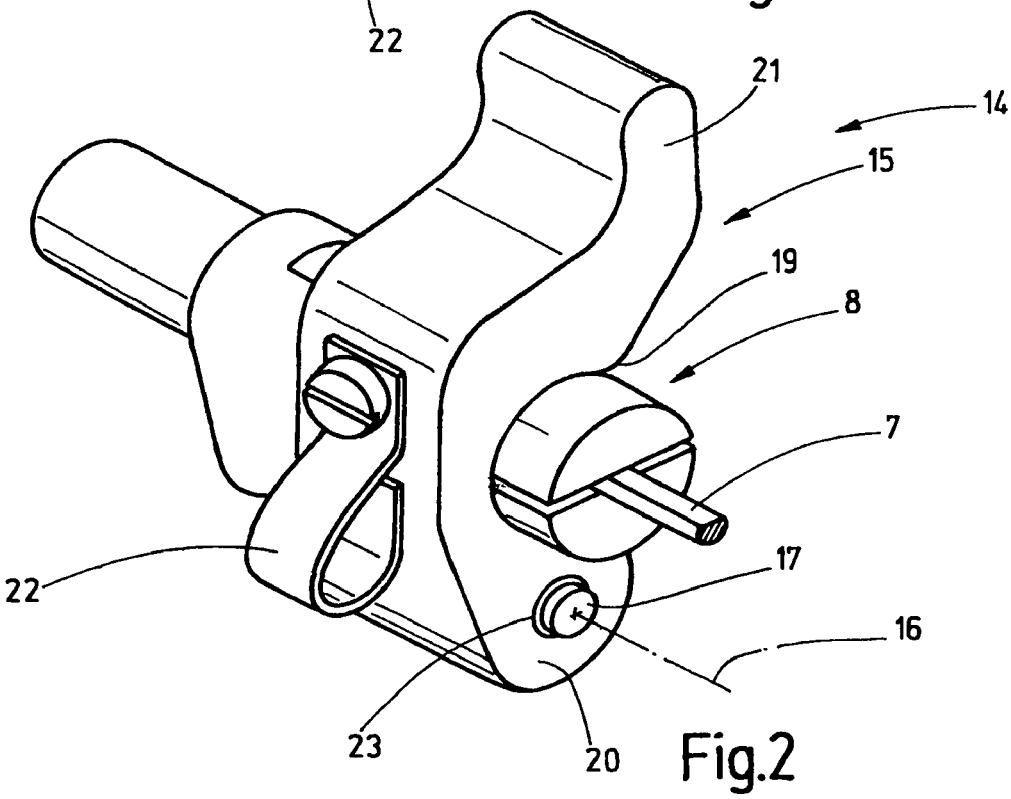
FIG. 2 shows the needle holder in accordance with FIG. 1, in a tensioned state.

The notch lever 15 consists, for example, of a slightly resilient plastic material. It is provided with an opening or a recess 18 that approximately follows the cylindrical contour that is defined, together by the needle-receiving part 2 and the needle clamping part 8 when the needle clamping part 8 is in clamping position as shown by FIG. 2. In so doing, the contour of the recess 18 follows the contour of the cylinder up to a projection 19 with which the notch lever 15 extends over the needle clamping part 8, thus tensioning against the end 7 of the needle.

The one bearing end 20 of the lever 15 is seated on the pin 17 and has a handle end 21 located on the opposite side, said handle end acting as a feature for moving the lever 15 out of its release position shown in FIG. 1 into its fixing position shown in FIG. 2. In addition, a thread guide 22 configured as an eyelet may be held on the notch lever 15. Particularly suitable therefore is the rear side of the notch lever 15 facing away from the recess 18. The thread guide 22 may be represented by a screwed-on bent sheet metal piece.

Furthermore, the notch lever 15 is secured on the journal 17 by means of a retaining ring.

In some embodiments the notch lever 15 may consist entirely of slightly elastic plastic material, as mentioned, and can thus itself provide the spring action with respect to the radial direction of the journal 17, as is necessary for the engagement effect. It is also possible to make the notch lever 15 of a stiff material, for example metal, and to provide elastic means in the region of its recess 18, for example, in the form of resiliently supported tongues or other elements, elastic linings or the like. Furthermore, it is possible to elastically support the journal 17 or to provide an elastic bushing or similarly elastic means between the journal 17 and the bearing end 20. All of these measures and additional corresponding measures are suitable to permit the projection 19 to yield in an elastic manner when said projection is pushed over the rounded outside of the needle clamping part 8.

FIG. 3 illustrates the needle holder 1 in a side view, in closed state, in which case the notch lever 15 has been omitted. As is obvious, the end 7 of the needle is clamped between the needle clamping part 8 and the needle-receiving part 2.

However, as shown by FIG. 4, positioning of the end 7 is defined by a pin 24 which fits into a notch 25 of the plunger or end 7 of the needle. The pin 24 is arranged at least approximately parallel to a pin 26 seated in the transverse bore 11, thus forming the hinge joint for the needle clamping part 8. The pin 24 traverses the depression-shaped or channel-shaped seat 6.

The needle holder 1 described so far operates as follows:

In order to change the needle, the notch lever 15 is moved into a release position, as shown by FIG. 1, in that said lever is pivoted away from the needle clamping part 8. This part is now freely movable and can be pivoted away from the needle or its end 7. In so doing, the needle clamping part 8 frees a semi-cylindrical space relative to a longitudinal central axis 13, said space being largely cleared, preferably completely cleared, so that the needle is exposed to daylight in its seat 6. The needle may be removed, e.g., by hand, and, if necessary be replaced in the seat or be exchanged for another needle. In so doing, the removal direction of the needle is transverse to the longitudinal direction of the needle. In order to clamp the needle in place, the needle clamping part 8 is moved from the release position shown by FIG. 1 to the end 7 of the needle. In so doing, the notch lever 15 is slid over the needle clamping part 8 by a pivoting motion, as shown by FIG. 2. Due to the adapted diameter of the recess 18, as well as due to the flexibility or elasticity of the notch lever 15, the clamping element 8 is pushed against the end 7 and thus fixed in clamping position. Consequently, the notch lever 15 forms a fixing element for the clamping part 8.

The needle holder forms a quick-release clamping holder which can be opened and closed with a few particularly simple motions of the hands, so that exchanging the needle is particularly easy.

Figure 6:
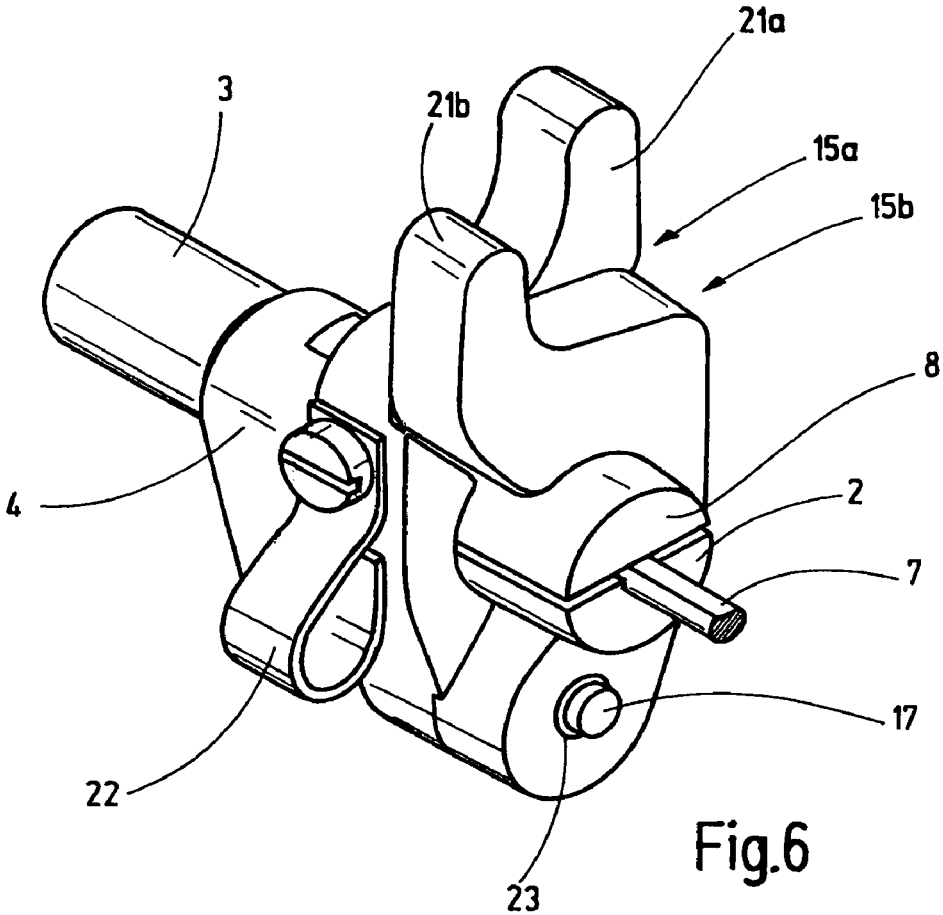
FIG. 6 shows the needle holder in accordance with FIG. 5, in a tensioned state.

FIG. 5 shows a modified embodiment of the needle holder 1. Different from the description so far, the journal 17 supports two notch levers 15*a*, 15, which can be pivoted in opposite directions, and whereby said levers can be slid from opposite sides over the needle clamping part 8. Other than that, the above description applies analogously, using the same reference numbers, whereby only details relating to the notch levers 15*a*, 15*b* are labeled with letters for differentiation. As is obvious from FIG. 6, in particular, the clamping levers 15*a*, 15*b*, together, form a fixing element for the needle clamping part 8. In fixing position, the handle ends 21*a*, 21*b* can be in alignment with each other or, as illustrated, can be offset relative to each other.

Figure 7:
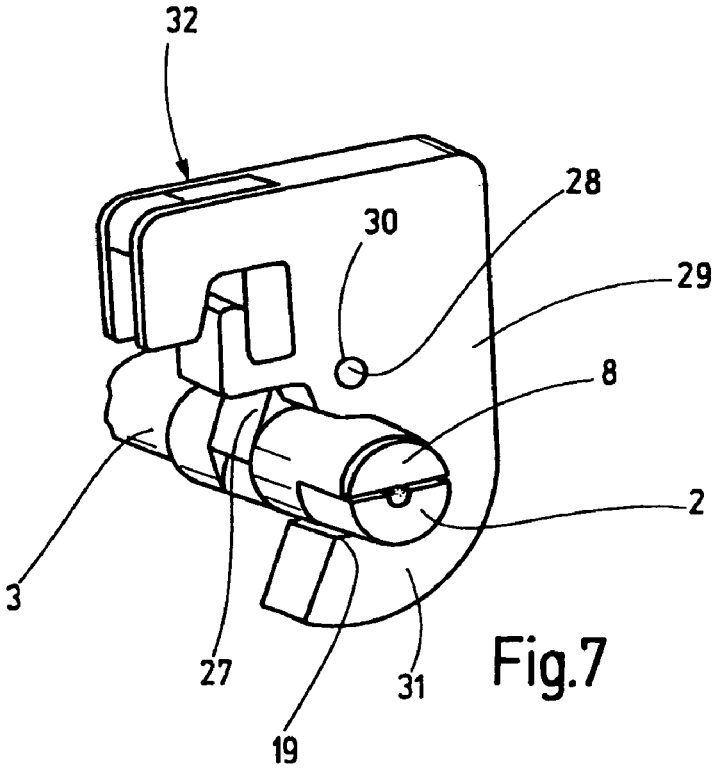
FIG. 7 is a perspective view of a third modification of the needle holder, in a firmly tensioned state.
Figure 8:
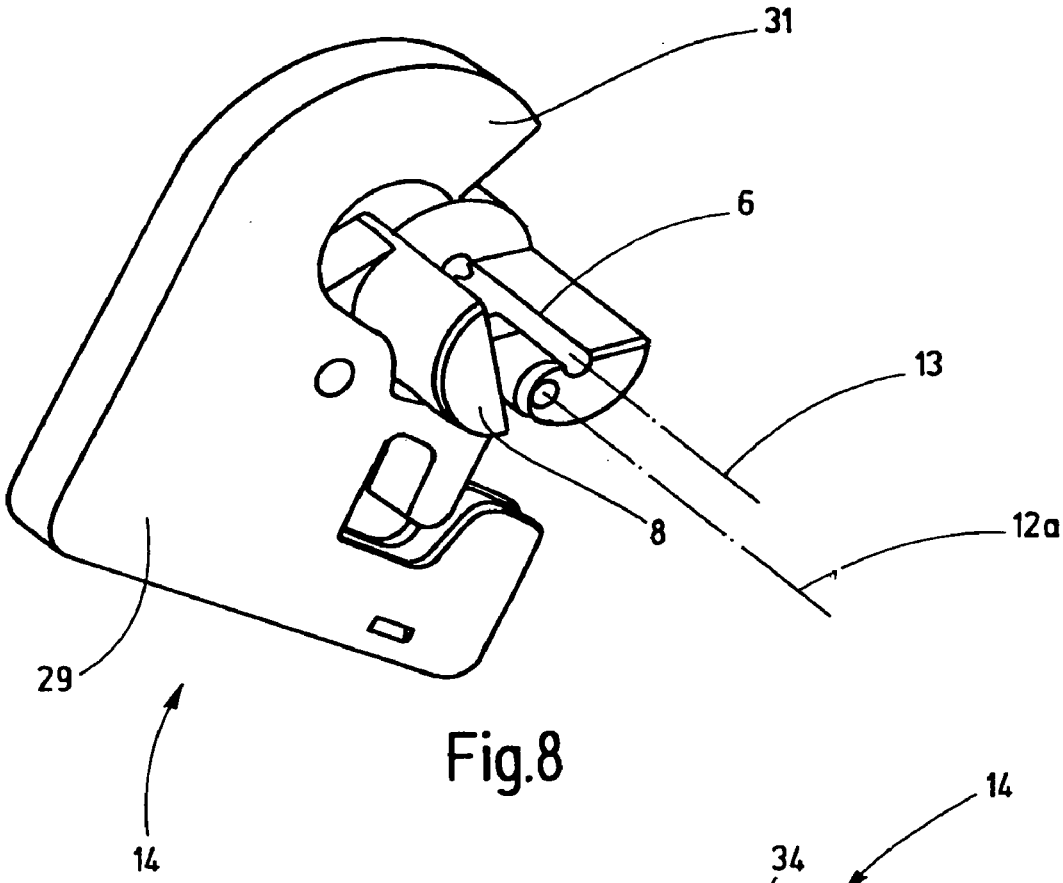
FIG. 8 is a perspective view of the needle holder in accordance with FIG. 7, in an opened state.

Referring to the above embodiments of the needle holder, the fixing element is supported on the needle-receiving part 2 or the body 4 that is preferably connected seamlessly in one piece with the needle-receiving part. However, as is shown by FIGS. 7 and 8, it is also possible to support the fixing element on the needle clamping part 8. To do so, the needle clamping part 8—which, in turn, may have on its outside a preferably cylindrically curved surface (but need not be that way)—is provided with an extension 27, from which the journal 28 extends parallel to the longitudinal axis of a cylinder that is defined by the needle-receiving part 2 and the needle clamping part 8. Again, a notch lever 29 may be seated on the journal 28 as the fixing element, said notch lever having an appropriate opening 30 for the accommodation of the journal 28. The notch lever 29 has a hook-shaped end 31 that can extend around under the needle seat. On its opposite end, said hook-shaped end may be provided with a thread guide device 32.

The actuation takes place as is obvious from FIGS. 7 and 8. If the hook-shaped end 31 is slid under the needle-receiving part 2, the outermost section of the end 31 forms a projection 19 that engages the notch lever 29 in this position. At the same time, the needle clamping part 8 is tensioned against the needle-receiving part 2. If the end 31, however, is moved away from the needle-receiving part 2 by appropriately pivoting the notch lever, the needle clamping part 8 is released. It can now be folded into the open position. As shown by FIGS. 1 and 2, this is accomplished with a needle clamping part 8 that can be pivoted about a pivot axis 12 transverse to the needle. This can also be accomplished with other embodiments, in which the needle clamping part 8, as shown in particular by FIG. 8, can be pivoted about a pivot axis 12*a* that is oriented parallel to the longitudinal extension of the seat 6 and thus is aligned with the longitudinal axis 13 that is also indicated in FIG. 8. Other than that, the previous description, in particular also with regard to the pin 24, applies analogously.

Figure 9:
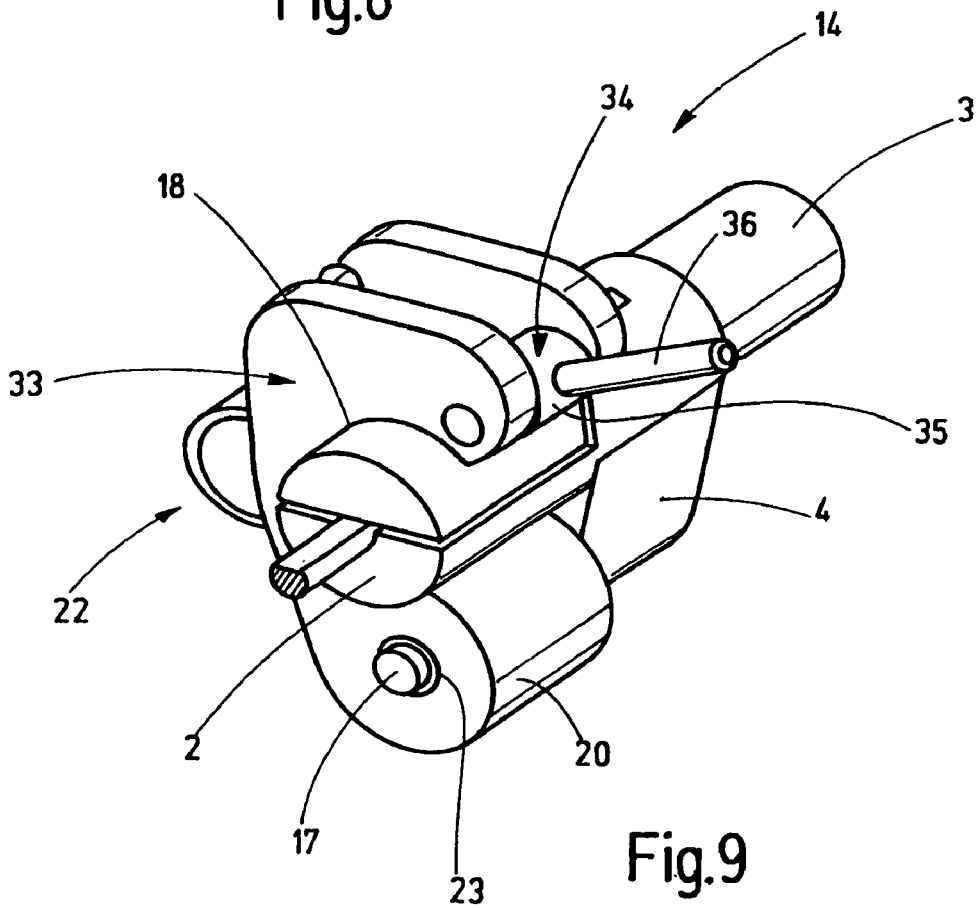
FIG. 9 is a perspective view of a fourth modification of the needle holder, in a closed state.

FIG. 9 shows another modified embodiment of the invention. This embodiment is essentially based on the embodiment in accordance with FIGS. 1 and 2, with analogous reference being made to the description of said embodiment and using the same reference numbers. However, there are differences regarding the design of the fixing element which, in this case is not configured as a notch lever but as a clamping lever 33. Said latter lever is provided with a pivotally supported lever-actuated eccentric clamping device 34, instead of with a detent projection. The lever-actuated eccentric clamping device 34 is represented by a clamping cam 35 that is arranged on the clamping lever 33 so as to be pivotable and preferably located on the outermost end or edge of said lever's recess 18. It replaces the (detent) projection 19. A pin 36 that radially extends away from the clamping cam 35 acts as the lever for tightening and releasing the clamping cam 35.

Figure 10:
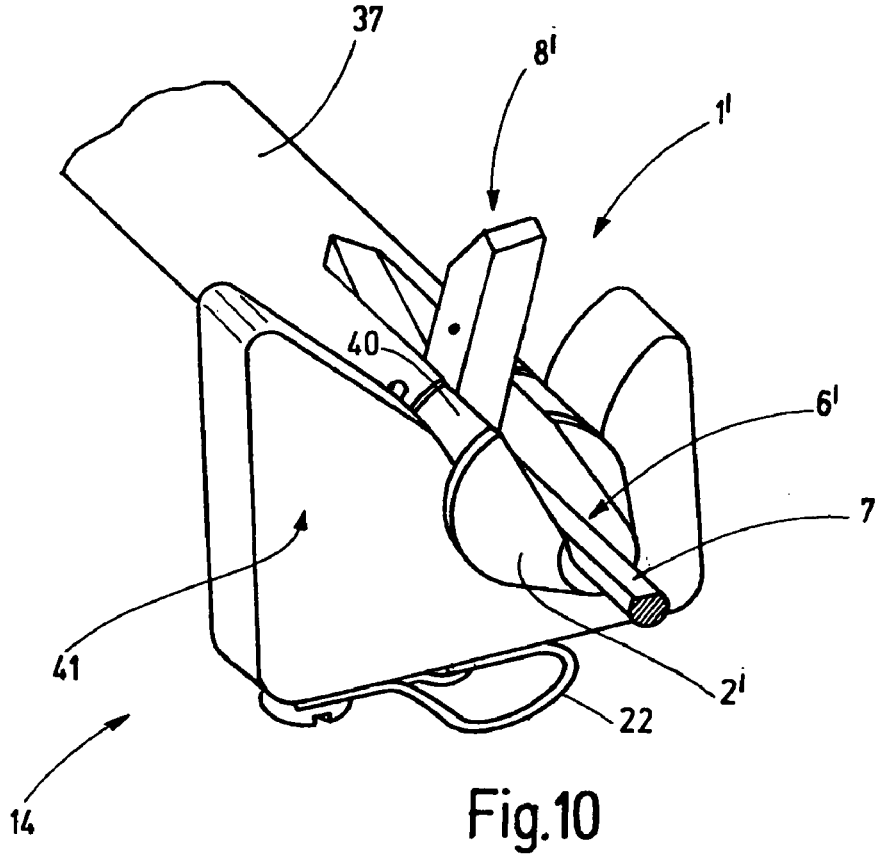
FIG. 10 is a perspective view of a fifth modification of the needle holder, in an opened state.
Figure 11:
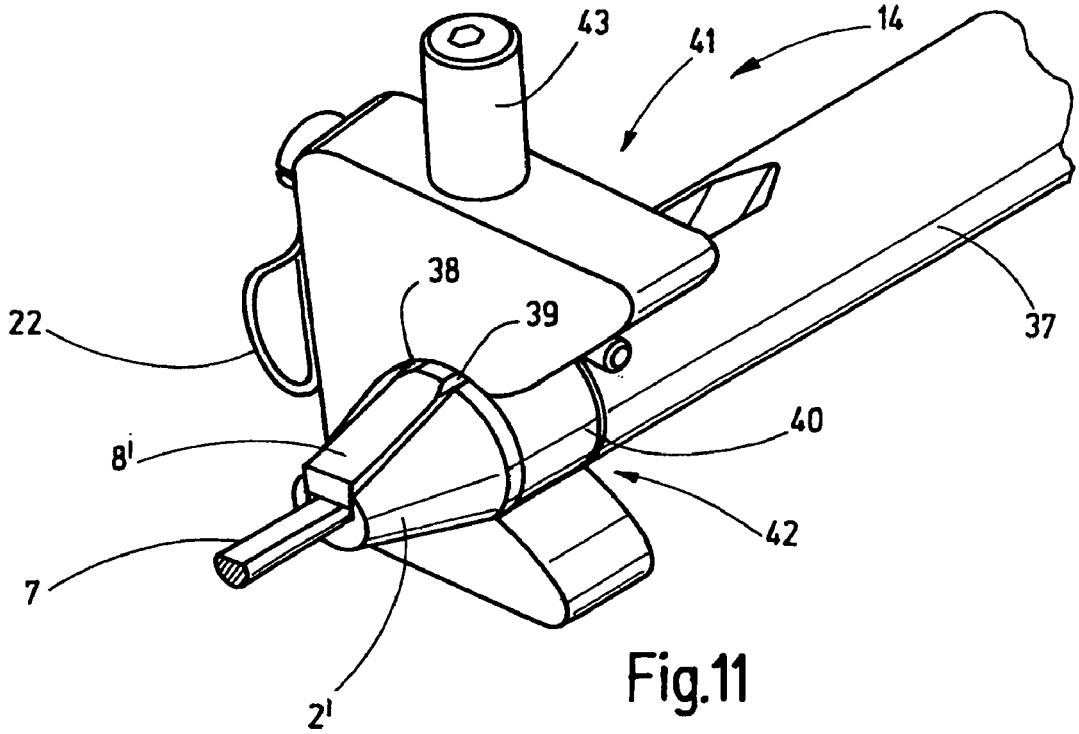
FIG. 11 is a perspective view of the needle holder in accordance with FIG. 10, in a closed state.

FIGS. 10 and 11 show another possible modification. This embodiment applies similar principles as the above-described embodiments. However, different from the aforementioned embodiments, it is particularly suitable for the direct integration in a needle rod 37, while, based on the above-described concept, the needle holder 1 is intended as an attachment component for a needle rod.

Thus, in accordance with FIGS. 10 and 11, the needle rod 37 forms its own needle holder 1', whereby its needle-side end is configured accordingly. A longitudinal groove is provided in the end of the needle rod so that the end of the needle rod 37 forms the needle-receiving part 2' with the seat 6'. The end 7 of the needle can be placed in this seat 6'. In the groove forming the seat 6', the needle clamping part 8' having the shape of a tongue or finger can be pivoted in the groove and be folded into the groove. In so doing, the needle clamping part 8' is dimensioned in such a manner that said clamping part projects minimally beyond the outside circumference of the end of the needle rod 37 when said clamping part is in clamping position, i.e., in the groove. As is obvious from FIG. 11, said clamping part's rear-side edges are provided with chamfers 38, 39, i.e., they are chamfered, so that a fixing part can be smoothly pushed beyond the needle clamping part 8', or its section that projects beyond the outside circumference of the needle rod 37, in order to fix the needle in place.

Around the end of the needle rod 37, i.e., around the needle-receiving part 2', there is a flat groove 40 in which is seated a fixing element. In this case, this element is represented by a rotary body 41 that is seated with an opening on the needle-receiving part 2' in the groove 40 and, in so doing, extends around the needle-receiving part 2'. However, the edge of the opening of the rotary body 41 is not continuously closed. Rather, the edge has a passage 42 which can act as a passage for the needle clamping part 8'. FIG. 10 shows the release position, and FIG. 11 shows the clamping position. In clamping position, the rotary body 41 is slid over the needle clamping part 8' in such a manner that said body tensions said clamping part against the end 7 of the needle. In order to move the clamping body 41, a handle 43 connected thereto may be used. Other than that, the above description applies analogously, with the supplementary use of the same reference numbers.

Figure 12:
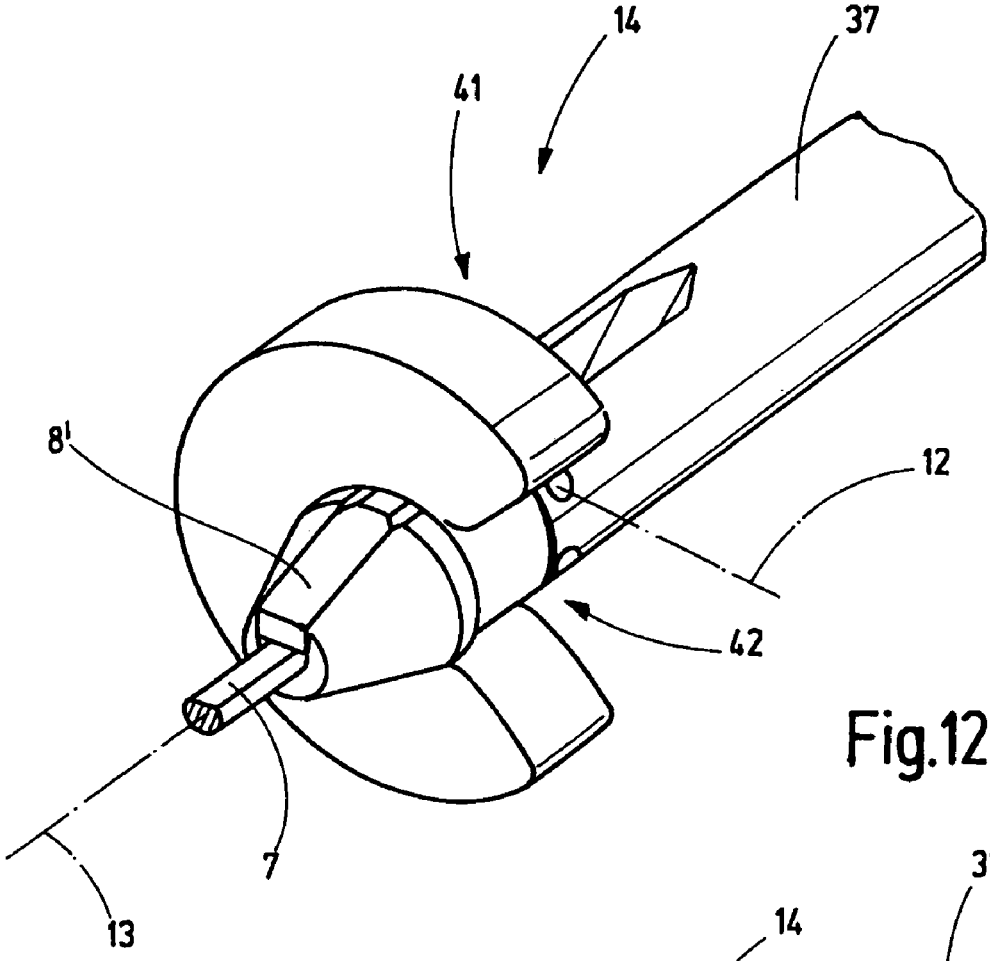
FIG. 12 is a perspective view of a sixth modification of the needle holder in accordance with the invention.

Additional modifications are possible. For example the rotary body 41 may be rounded on its outside, as shown by FIG. 12, in which case—other than that—the description of the embodiments in accordance with FIGS. 10 and 11 applies analogously.

The rotary body 41 may consist, for example, of plastic material, or it may also consist of another less resilient material such as, for example metal. It may be made in such a manner that said rotary body tensions the needle clamping part 8' against the end 7 of the needle when said rotary body is rotated about the longitudinal central axis 13 and thus slid over the outward-located rear surface of the needle clamping part 8'. In so doing, this longitudinal central axis 13 represents the axis of rotation for the rotary body 41.

Figure 13:
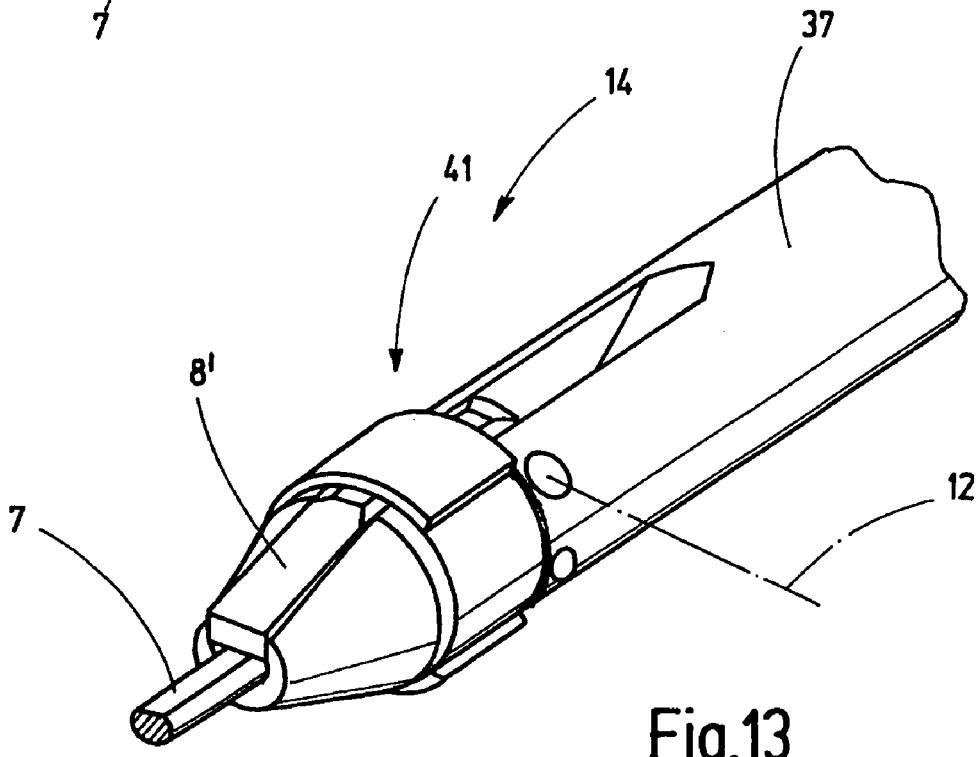
FIG. 13 is a perspective illustration of a seventh modification of the needle holder in accordance with the invention.

As shown by FIG. 13, the rotary body 41 may also be configured as a slim C-clip. This clip is slightly resilient in radial direction and, in clamping position of the needle clamping part 8', pushes against the end 7 of the needle. When the rotary body 41 is rotated away from the needle clamping part 8', said rotary body releases said needle clamping part. The needle clamping part can be folded out of the groove analogously to FIG. 10, thus releasing the needle.

Referring to another exemplary embodiment (not illustrated), the rotary body 41 is configured as a slim bushing that is slid over the needle clamping part 8' in order to clamp the needle clamping part 8' in place the longitudinal direction of the needle. To do so, the groove 40 is wider in axial direction, so that sliding the rotary body or the sliding body 41 becomes possible. For the release of the needle clamping part 8', the sliding body 41 is slid in the direction of the needle rod 37 until the needle clamping part 8' can be folded open.

All the above-described embodiments, together, have in common that a needle clamping part 8, 8'—that is movable in whatever way, in particular, pivotable—is secured in clamping position by means of a fixing element 14, in which case the fixing element 14 is supported so as to be rotatable or pivotable about a rotational axis or pivot axis 16 or 13, said axis coinciding with the longitudinal central axis of the needle or being oriented parallel thereto. As a result of this, simple and rapid handling is possible.

A quick-release clamping holder for a sewing needle, embroidery needle or the like has a needle receptacle 2 on which a needle clamping part 8 is preferably pivotally supported. A fixing element 14 is provided in order to clamp and fix the needle clamping part 8 in place, whereby said fixing element is pivotally or rotatably supported relative to a longitudinal central axis 13 of the needle and thus can be slid onto and off the needle clamping part 8. Actuation is simple and safe.

It will be appreciated that the above description of the present invention is susceptible to various modifications, changes and modifications, and the same are intended to be comprehended within the meaning and range of equivalents of the appended claims.

| List of Reference Numbers: | |
|---|---|
| 1, 1' | Needle holder |
| 2, 2' | Needle-receiving part |
| 3 | Journal |
| 4 | Body |
| 5 | Surface |
| 6, 6' | Seat |
| 7 | End |
| 8, 8' | Needle clamping part |
| 9 | Surface |
| 10 | Extension |
| 11 | Transverse bore |
| 12 (a) | Pivot axis |
| 13 | Longitudinal central axis |
| 14 | Fixing element |
| 15 (a, b) | Notch lever |
| 16 | Pivot axis |
| 17 | Journal |
| 18 | Recess |
| 19 | Projection |
| 20 | Bearing end |
| 21 (a, b) | Handle end |
| 22 | Thread guide |
| 23 | Retaining ring |
| 24 | Pin |
| 25 | Notch |
| 26 | Pin |
| 27 | Extension |
| 28 | Journal |
| 29 | Notch lever |
| 30 | Opening |
| 31 | End |
| 32 | Thread guide device |
| 33 | Clamping lever |
| 34 | Lever-actuated eccentric clamping device |
| 35 | Clamping cam |
| 36 | Pin |
| 37 | Needle rod |
| 38, 39 | Chamfers |
| 40 | Groove |
| 41 | Rotating body |
| 42 | Passage |
| 43 | Handle |

What is claimed is:

1. Needle holder, in particular for Schifflin needles, comprising:

a needle-receiving part having an elongated seat configured for the accommodation of an end of a needle;

a needle clamping part that is connected to the needle-receiving part and can be moved between a clamping position and a release position about a rotational or pivot axis that is oriented in a direction transverse to a longitudinal axis of the seat;

at least one fixing element that can be moved between a fixing position, in which it holds the needle clamping part in the clamping position, and a release position, in which it releases the needle clamping part, with said fixing element being supported so as to be pivotable or rotatable about a pivot axis or a rotational axis that is parallel or concentric to the longitudinal axis of the seat; and wherein the fixing element, for fixing the needle clamping part, is slid onto the needle clamping part or onto the needle-receiving part and, for releasing the needle clamping part, is moved away from said clamping part or is moved away from the needle-receiving part.

2. Needle holder in accordance with claim 1, wherein the needle-receiving part has a longitudinal channel-like recess as the seat.

3. Needle holder in accordance with claim 2, wherein, in the channel-like recess, a transversely arranged pin or a transverse rib is provided.

4. Needle holder in accordance with claim 1, wherein the needle clamping part is rotatably or pivotally supported on the needle-receiving part.

5. Needle holder in accordance with claim 1, wherein, when clamping in place the end of the needle, the needle clamping part is moved into a space that is radial with respect to the end of the needle and above the seat for said needle, and that, during release, the needle clamping part is moved out of this space region.

6. Needle holder in accordance with claim 1, wherein the needle clamping part and the needle-receiving part essentially complement each other to form a cylindrical external contour when the needle clamping element is in clamping position.

7. Needle holder in accordance with claim 1, wherein the rotational or pivot axis of the needle clamping part is oriented in a direction parallel to a separating surface between the needle clamping part and the needle-receiving part.

8. Needle holder in accordance with claim 1, wherein the fixing element is associated with at least one detent means in order to hold the fixing element in fixing position.

* * * * *